United States Patent [19]

Volkstorf et al.

[11] Patent Number: 4,733,615

[45] Date of Patent: Mar. 29, 1988

[54] CARRIER RAIL FOR OVERHEAD CONVEYORS

[75] Inventors: Hans-Hermann Volkstorf; Edwin Feldmeier, both of Rheinfelden, Fed. Rep. of Germany; Marc Walti, Grenchen, Switzerland

[73] Assignee: Rene Blaser, Lucerne, Switzerland

[21] Appl. No.: 838,374

[22] Filed: Mar. 11, 1986

[30] Foreign Application Priority Data

Mar. 19, 1985 [DE] Fed. Rep. of Germany ..... 8508070

[51] Int. Cl.[4] ..... B61B 3/02; E01B 25/22

[52] U.S. Cl. ..... 104/110; 104/93

[58] Field of Search ..... 104/93, 107, 109, 110, 104/91, 94, 95, 111; 191/23 A, 45 A

[56] References Cited

U.S. PATENT DOCUMENTS 4,015,537 4/1977 Graef et al. ..... 104/107 X
4,480,157 10/1984 Ishikura et al. ..... 104/93
4,520,733 6/1985 Willmann ..... 104/93
4,545,303 10/1985 Fujita et al. ..... 104/93

FOREIGN PATENT DOCUMENTS 92608 11/1983 European Pat. Off. ..... 104/110
8204451 12/1982 World Int. Prop. O. ..... 104/110

*Primary Examiner*—David A. Scherbel
*Attorney, Agent, or Firm*—Collard, Roe & Galgano

[57] ABSTRACT

A carrier rail for overhead conveyors includes an upper and a lower flange connected together by a web. Angled profiles are disposed on at least one side of the web and are spaced apart interiorly of the flanges. The profiles and the web cooperatively define together at least two grooves therein. Each of the two grooves has an opening and the grooves are directed so that the openings face each other. The angled profiles are preferably integrally formed with the web, and form right angles with the web. Two angled profiles may be disposed on each side of the web, and form four grooves with the web.

1 Claim, 1 Drawing Figure

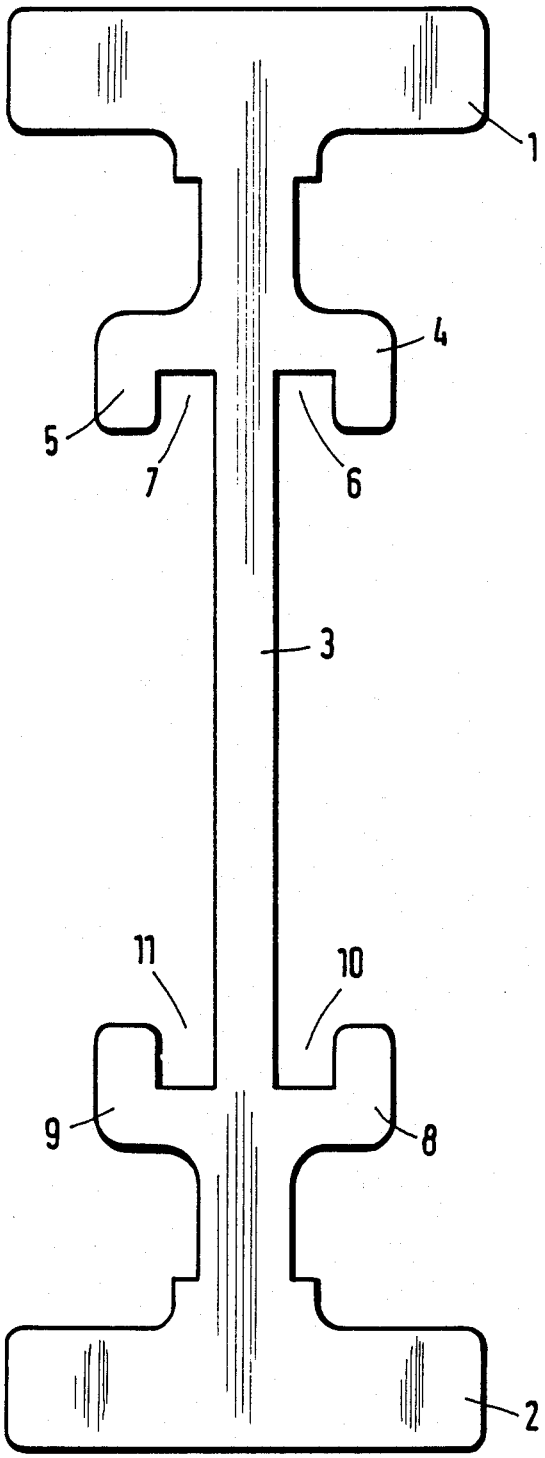
1
4
5
7
6
3
11
10
9
8
2

CARRIER RAIL FOR OVERHEAD CONVEYORS

BACKGROUND OF THE INVENTION

The invention relates to a carrier rail for overhead conveyors. More particularly, it relates to a carrier rail for overhead conveyors which includes an upper and a lower flange connected together by a vertical web.

In German Gebrauchsmuster No. 84 04 118.4 a carrier rail of this type is described, in which on the under- or innerside of the flanges, outside of the pressure plane developed upon bending of the rail, and on both sides of the web, longitudinally extending ledges are provided to form longitudinal grooves between the web and ledges. These longitudinal grooves serve to secure the fastening devices for electrical conductors, and accurate guide or control markings or the like, without changing the rail.

Accordingly, it is an object of the present invention to provide an improved carrier rail which has complete independence from the longitudinal grooves of the flanges, so as to prevent a compressing or tensioning of the longitudinal grooves on bending of the rail, or the curves corresponding to the course of the rail.

SUMMARY OF THE INVENTION

The foregoing and related objects are readily attained in a carrier rail of the type described above wherein at one or both sides along the two faces of the web, angled profiles are arranged at a distance from the underside of the flanges, to form two or four grooves. The invention affords the significant advantage that the longitudinal grooves are not compressed on bending the curves corresponding to the course of the rail. A further feature of the invention is to use the web surfaces between upper and lower flange, and the angled profiles arranged on the web, for mounting track measuring systems, for example, toothed racks, adhesive films having a distance grating or screen, or similar systems, and thereby to control a vehicle traveling on the profile.

According to a preferred embodiment, each two grooves on one side of the web are directed so that their openings are opposed, i.e., the opening of the groove of the lower flange faces upwards and the opening of the groove of the upper flange faces downwards. The angled profiles may be formed integral with the web and, preferably, may form a right angle to the web surfaces.

Other objects and features of the present invention will become apparent from the following detailed description considered in connection with the accompanying drawing, which discloses one embodiment of the invention. It is to be understood that the drawing is to be used for the purpose of illustration only, and not as a definition of the limits of the invention.

BRIEF DESCRIPTION OF THE DRAWING

The drawing is a cross-sectional view of the carrier rail according to the invention.

DETAILED DESCRIPTION OF THE PREFERRED EMBODIMENT

Turning now in particular to the appended drawing, therein illustrated is a novel symmetrical, double-T carrier rail, embodying the present invention, which includes an upper flange 1 and a lower flange 2, which are joined together by a vertical web 3. At a distance from upper flange 1, two angled profiles 4 and 5 are arranged on web 3, and form longitudinally-extending grooves 6,7 with web 3. In the same way, two angled profiles 8,9 are arranged at a distance from lower flange 2, and form two longitudinally-extending grooves 10,11 on opposite sides of the web. Grooves 6,10 or 7,11 are arranged so that their openings are opposite to each other. Angled profiles 4,5 and 8,9 can be formed integral with web 3 and the two flanges 1 and 2, respectively. In the specific embodiment illustrated in the drawing, angled profiles 4,5 and 8,9 form a right angle to web 3. Longitudinal grooves 6,7 and 10,11 may be used to easily attach electrical conductors, guide controls, joint connectors, overhead suspensions, etc., to the rail.

Thus, while only a single embodiment of the present invention has been shown and described, it will be obvious that many changes and modifications may be made thereunto, without departing from the spirit and scope of the invention.

What is claimed is:

1. A symmetrical, double T carrier rail for overhead conveyors comprising:

an upper solid and a lower solid flange connected together by a solid web; and two opposed pairs of angled profiles integrally formed with said web at right angles thereto with one pair disposed on each side of said web, each angled profile being spaced interiorly from said upper and lower flanges, each of said angled profiles and said web cooperatively defining a groove therebetween, and wherein said grooves on the same side of said web face each other.

* * * * *